US005800189A

United States Patent [19]

Ahmed

[11] Patent Number: 5,800,189

[45] Date of Patent: Sep. 1, 1998

[54] APPARATUS AND METHOD FOR AUTOMATIC DISCONNECTOR

[76] Inventor: Samir Omar Ramsey Ahmed, 512 Easton Rd., Riegelsville, Pa. 18077

[21] Appl. No.: 665,455

[22] Filed: Jun. 18, 1996

[51] Int. Cl.[6] ..... H01R 13/62

[52] U.S. Cl. ..... 439/159; 439/923

[58] Field of Search ..... 439/152, 155, 439/159, 923

[56] References Cited

U.S. PATENT DOCUMENTS

| | | | |
|---|---|---|---|
| 2,427,390 | 9/1947 | Dear | 439/152 |
| 3,475,715 | 10/1969 | Venaleck | 439/159 |
| 3,936,123 | 2/1976 | Gossett et al. | 439/155 |
| 4,045,106 | 8/1977 | Borg | 439/152 |
| 4,118,690 | 10/1978 | Daynton | 439/159 |
| 4,157,855 | 6/1979 | Chan | 439/155 |
| 4,314,735 | 2/1982 | Fullenkamp | 439/152 |
| 4,508,404 | 4/1985 | Frawley | 439/155 |
| 4,542,284 | 9/1985 | Thaler et al. | 219/506 |
| 4,586,768 | 5/1986 | Eck | 439/155 |
| 4,778,400 | 10/1988 | Jacobs | 439/152 |
| 4,850,886 | 7/1989 | Berks | 439/182 |
| 5,083,042 | 1/1992 | Merchant | 307/149 |
| 5,211,569 | 5/1993 | Havens | 439/159 |
| 5,266,040 | 11/1993 | Merrill et al. | 439/159 |
| 5,293,296 | 3/1994 | Carl | 361/93 |
| 5,453,899 | 9/1995 | Page | 361/1 |
| 5,635,690 | 6/1997 | Krecht et al. | 200/51.09 |
| 5,645,439 | 7/1997 | Myert, Jr. et al. | 439/159 |

FOREIGN PATENT DOCUMENTS

| | | | |
|---|---|---|---|
| 344850 | 12/1989 | European Pat. Off. | 439/159 |

*Primary Examiner*—Neil Abrams
*Assistant Examiner*—Brian J. Biggi
*Attorney, Agent, or Firm*—Adel A. Ahmed

[57] ABSTRACT

An automatic disconnector for a plug includes an ejector for ejecting the plug from an outlet socket; a sensor for sensing current flow through the plug and for sensing a substantial cessation of the current flow. Upon occurrence of a substantial cessation of current flow, the ejector operates to eject the plug from the outlet. The disconnector is optionally integrally formed with the plug or with the outlet socket. An optional keyed plug is utilizable for selectively enabling the disconnector.

38 Claims, 4 Drawing Sheets

APPARATUS AND METHOD FOR AUTOMATIC DISCONNECTOR

The present invention relates generally to plugs and sockets for electrical appliances and the like and, more particularly, to plugs and outlet sockets such as may be used in conjunction with an electric power cord for coupling an electrical device to a source of operating power such as the electric mains supply or it may form part of a plug-in power supply unit for providing operating power to an appliance or instrument.

An arrangement is known in the art for utilizing a spring to eject a plug from an electrical outlet, as disclosed in U.S. Pat. No. 5,211,569 issued May 18, 1993 in the name of Havens and entitled ELECTRICAL POWER CORD AND APPLIANCE USING SAME, and whereof the disclosure is herein incorporated by reference, to the extent it is not inconsistent with the present invention. An object of the aforesaid patent, as is explained in column 1, lines 40–49 thereof, is to provide an electrical power supply cord and appliance including such an electrical power supply cord wherein a self-ejecting plug is provided on the supply cord and means is provided to remotely-control ejection of the plug in a manner to save the user of the cord/appliance from having to return to the electrical outlet to disengaged the plug therefrom when the user reaches the maximum operating length of the power cord.

As explained in column 1, lines 16–39 of the aforesaid patent, typically a user begins floor polishing proximate a wall outlet and continues operation at gradually increasing distances from the wall outlet until the power supply cord reaches its maximum length. Then the user must walk back to the wall outlet, remove the power cord plug from the outlet and proceed to the next wall outlet where the power cord plug is inserted to continue operation of the appliance. This sequence is repeated until the entire work area has been treated by the appliance. Operation of the appliance in this manner is time-consuming and laborious, particularly, for example, when the entire length of a long hallway or corridor has to be polished.

The arrangement described in the afore-mentioned patent utilizes a wire coil which is energized so as to disengage an interlock and allow a spring to eject the plug from the outlet. When a button is pressed, a supply current is provided to the coil by way of a supply wire 224*a*. See column 6, lines 11–22 of the aforesaid patent.

U.S. Pat. No. 5,266,040, issued Nov. 30, 1993 in the names of Merrill et al., entitled RELEASABLE ELECTRIC CONNECTOR ASSEMBLY, and whereof the disclosure is herein incorporated by reference, to the extent it is not inconsistent with the present invention, discloses a release mechanism for an electrical plug for releasing the plug from a socket. The release mechanism includes a perimeter ejecting member which substantially surrounds the electrical contact prongs of the plug is moveable with respect thereto. A remote switch is energized, which activates the release mechanism and disengages the plug from the socket by sliding over the contact prongs.

An ejecting outlet and adapter is disclosed in U.S. Pat. No. 5,293,296, entitled EJECTING OUTLET AND ADAPTER, issued Mar. 8, 1994, in the name of Carl, and whereof the disclosure is herein incorporated by reference, to the extent it is not inconsistent with the present invention. An ejecting electrical outlet has magnets positioned within the electrical receptacle. Springs are positioned between the magnets and are compressed when the prongs of a plug are entered into the outlet. The strength of a magnetic field generated by an overload electric current is sufficient to defeat the attractive forces between the magnet and to permit decompression of the spring and ejection of the plug from the electrical outlet.

Related information in the art area is also provided in, for example, U.S. Pat. No. 4,778,400 issued Oct. 18, 1988 in the name of Jacobs and entitled REMOTE ELECTRICAL CONNECTOR; U.S. Pat. No. 4,508,404 issued Apr. 2, 1985 in the name of Frawley and entitled REMOTE CONNECT AND DISCONNECT ASSEMBLY WITH ENERGY ISOLATION; U.S. Pat. No. 4,314,735 issued Feb. 9, 1982 in the name of Fullenkamp et al. and entitled BED LOCATOR HAVING AN INTEGRAL ELECTRIC SOCKET AND A PLUG EJECTOR; U.S. Pat. No. 4,157,855 issued Jun. 12, 1979 in the name of Chan and entitled ELECTRIC SOCKET AND PLUG; U.S. Pat. No. 4,850,886 issued Jul. 28, 1989 in the name of Berks and entitled POWER CORD DECOUPLER AND METHOD; U.S. Pat. No. 4,586,768 issued May 6, 1986 in the name of Eck and entitled ELECTRICAL CONNECTOR PLUG WITH AN INTEGRAL EJECTOR; U.S. Pat. No. 3,936,123 issued Feb. 3, 1976 in the names of Gossett et al. and entitled ELECTRICAL PLUG EJECTING APPARATUS; U.S. Pat. No. 4,045,106 issued Aug. 30, 1977 in the name of Borg and entitled AUTOMATIC ELECTRICAL PLUG RELEASE. The disclosure of the afore-listed patents is herein incorporated by reference, to the extent it is not inconsistent with the present invention.

It is apparent that the arrangement of the aforementioned U.S. Pat. No. 5,211,569, for example, disengagement of the plug from the socket requires the pressing of a button by the user. Furthermore, a special conductor is required in the line cord for supplying current to a coil or solenoid, as therein described.

It is herein recognized that, with regard to particular types of appliances, and in certain applications, it may be desirable to have the plug eject automatically from the outlet socket upon completion of use of the appliance or apparatus. Preferably, such operation should be automatic, without the need for an operator to actuate the ejection.

For example, a hair dryer of the type in common use utilizes a blower for blowing air through a heated electric element wire. When operation of the hair dryer is ended, the user may switch it off and then set it down on a table. If the switch is inadvertently operated through an accidental movement, or if a switch failure or short-circuit across the switch should occur, this will cause the hair dryer to restart. However, if the hair dryer has been set down on the air intake side for the blower, overheating may occur because of the reduced air flow and thereby create a fire hazard.

This situation may occur with other appliances utilizing heating elements, such as hot-air popcorn poppers, toasters, and the like.

It is also herein recognized that in certain other situations, it may desirable to unplug an appliance after it has been switched off. While ground fault interrupters are required in many situations where the presence of accessible good grounds presents a shock hazard, such as in bathrooms, kitchens, the outdoors, and so forth, on the one hand, many preexisting installations are not equipped with ground fault interrupters and, on the other hand, it is not considered good practice to allow exposure to a shock hazard, even with a ground fault interrupter, because it may on occasion fail to operate for any of a number of reasons. In the event that, for example, a supply line powered portable television receiver or radio receiver is operated in a bathroom, it may continue to pose a shock hazard after having been switched off, such as by tumbling into a filled bathtub.

Accordingly, it is an object of the present invention to provide improved user safety by causing an appliance plug to be automatically ejected from a wall outlet socket when the appliance operating current is switched off.

In accordance with yet another aspect of the invention, apparatus for ejecting a plug from an outlet includes a sensor for sensing a substantial cessation of current flow through the plug and an ejector coupled to the sensing means for ejecting the plug upon substantial cessation of the current flow.

In accordance with yet another aspect of the invention, the sensing apparatus comprises a solenoid.

In accordance with yet another aspect of the invention, the ejector apparatus comprises an ejector element and a spring-loaded latching mechanism responsive to the solenoid for controlling the element.

In accordance with yet another aspect of the invention, the latching mechanism operates to latch the ejector element in a retracted position upon insertion of the plug into the outlet, regardless of whether current is flowing through the plug at the moment of the insertion.

In accordance with yet another aspect of the invention, the latching mechanism operates to release the ejector element from the retracted position upon a substantial cessation of any current flowing through the plug.

In accordance with an aspect of the invention, an automatic disconnector for a plug comprises an ejector arrangement for ejecting the plug from an outlet, a sensing arrangement for sensing current flow through the plug and for sensing a substantial cessation of the current flow, and an arrangement coupling the ejector arrangement to the sensing arrangement for causing ejection of the plug upon the substantial cessation of the current flow.

In accordance with another aspect of the invention, an automatic disconnector for a plug comprises an arrangement for sensing whether a specially adapted plug has been inserted into the outlet.

In accordance with still another aspect of the invention, the arrangement for sensing whether a specially adapted plug has been inserted into the outlet is coupled to the ejector arrangement for inhibiting the ejection unless the specially adapted plug has been inserted into the outlet.

In accordance with yet another aspect of the invention, an automatic disconnector for a plug, comprises an arrangement for causing ejection of the plug upon substantial cessation of current flow through the plug; and an arrangement for sensing whether a specially adapted plug has been inserted into the outlet and for inhibiting the ejection unless a specially adapted plug has been inserted into the outlet.

In accordance with a further aspect of the invention, the sensing arrangement for sensing current flow through the plug and for sensing a substantial cessation of the current flow comprises an electromechanical arrangement.

In accordance with still a further aspect of the invention, the sensing arrangement for sensing current flow through the plug and for sensing a substantial cessation of the current flow comprises an electronic circuit.

In accordance with yet another aspect of the invention, an automatic disconnector for a plug comprises a plug portion having first and second prongs or blades for engaging electrical outlet receptacle contacts; apparatus for connecting the prongs to an electrical load; a selectively operable ejector having a retracted operating position and an extended operating position for causing the prongs to become separated from the contacts; biasing apparatus for urging the ejector to move into the extended operating position; a first selectively operable latch for holding the ejector substantially in the retracted operating position; a second selectively operable latch for holding the ejector substantially in the retracted operating position; and an electrically operated mechanism electrically coupled to at least one of the first and second prongs and being mechanically coupled for operating the latches in response to predetermined changes in current flow through the prongs.

In accordance with yet another aspect of the invention, the first selectively operable latch operates to hold the ejector in the retracted position upon insertion of the prongs into the electrical outlet in the event substantially no current is being drawn by the electrical load.

In accordance with yet another aspect of the invention, the second selectively operable latch operates to hold the ejector in the retracted position upon insertion of the prongs into the electrical outlet in the event a current is being drawn by the electrical load.

In accordance with yet another aspect of the invention, the second selectively operable latch includes apparatus for inhibiting further operation of the first selectively operable latch once current has been drawn by the electrical load.

In accordance with yet another aspect of the invention, the electrically operated mechanism operates to cause the second selectively operable latch to cease holding the ejector in the retracted position upon substantial cessation of the current being drawn by the electrical load.

In accordance with yet another aspect of the invention, the electrically operated device is a solenoid having an armature coupled for operating the latches.

In accordance with yet another aspect of the invention, the latches comprise respective cranks or bell-cranks, the first selectively operable latch is spring-loaded for operating to hold the ejector in the retracted position, the biasing apparatus for urging the ejector to move into the extended operating position comprises a spring, and wherein the apparatus for inhibiting further operation of the first selectively operable latch comprises a portion of the second latch for selectively engaging the first latch so as to prevent its operating to hold the ejector in the retracted position when the current is being drawn by the electrical load.

In accordance with yet another aspect of the invention, an automatic disconnector for a plug, comprises an electrical receptacle having first and second contacts for mating engagement with a plug portion having first and second prongs or blades; apparatus for connecting the contacts to an electrical supply; a selectively operable ejector having a retracted operating position and an extended operating position for causing the prongs to become separated from the contacts; biasing apparatus for urging the ejector to move into the extended operating position; a first selectively operable latch for holding the ejector substantially in the retracted operating position; a second selectively operable latch for holding the ejector substantially in the retracted operating position; an electrically operated mechanism electrically coupled to at least one of the first and second prongs and being mechanically coupled for operating the latches in response to predetermined changes in current flow through the prongs.

In accordance with yet a further aspect of the invention, an automatic disconnector for a plug includes sensing apparatus operable by a sensing element and being coupled to the electrically operated mechanism for selectively enabling and disabling operation thereof; and wherein the plug portion optionally exhibits a keying element for cooperatively engaging the sensing apparatus for enabling operation of the electrically operated mechanism.

In accordance with yet another aspect of the invention, the keying element is a lateral protuberance for engaging the sensing element.

In accordance with yet another aspect of the invention, the electrically operated mechanism is enabled for operation when a plug is utilized therewith exhibiting the keying element and wherein the electrically operated mechanism is disabled for operation when a plug is utilized therewith not exhibiting the keying element.

In accordance with yet another aspect of the invention, the sensing element comprises a spring-loaded pin for selectively blocking operation of the latches.

In accordance with yet another aspect of the invention, the sensing apparatus comprises a switch for selectively bypassing the electrically operated mechanism.

In accordance with still another aspect of the invention, a method for automatically ejecting for ejecting a plug from an outlet comprises the steps of sensing a substantial cessation of current flow through the plug; and, upon an occurrence of the substantial cessation of current flow, operating an ejection mechanism for ejecting the plug from the outlet.

In accordance with still yet another aspect of the invention, the method comprises latching the ejection mechanism in a retracted position upon insertion of the plug into the outlet, regardless of whether current is flowing through the plug at the moment of the insertion.

In accordance with still a further aspect of the invention, the method comprises operating the ejection mechanism to release the ejector element from the retracted position upon a substantial cessation of any current flowing through the plug.

The invention will be more closely described in conjunction with the drawing, in which FIG. 1 shows an exemplary embodiment in accordance with the invention;

Figure 1:
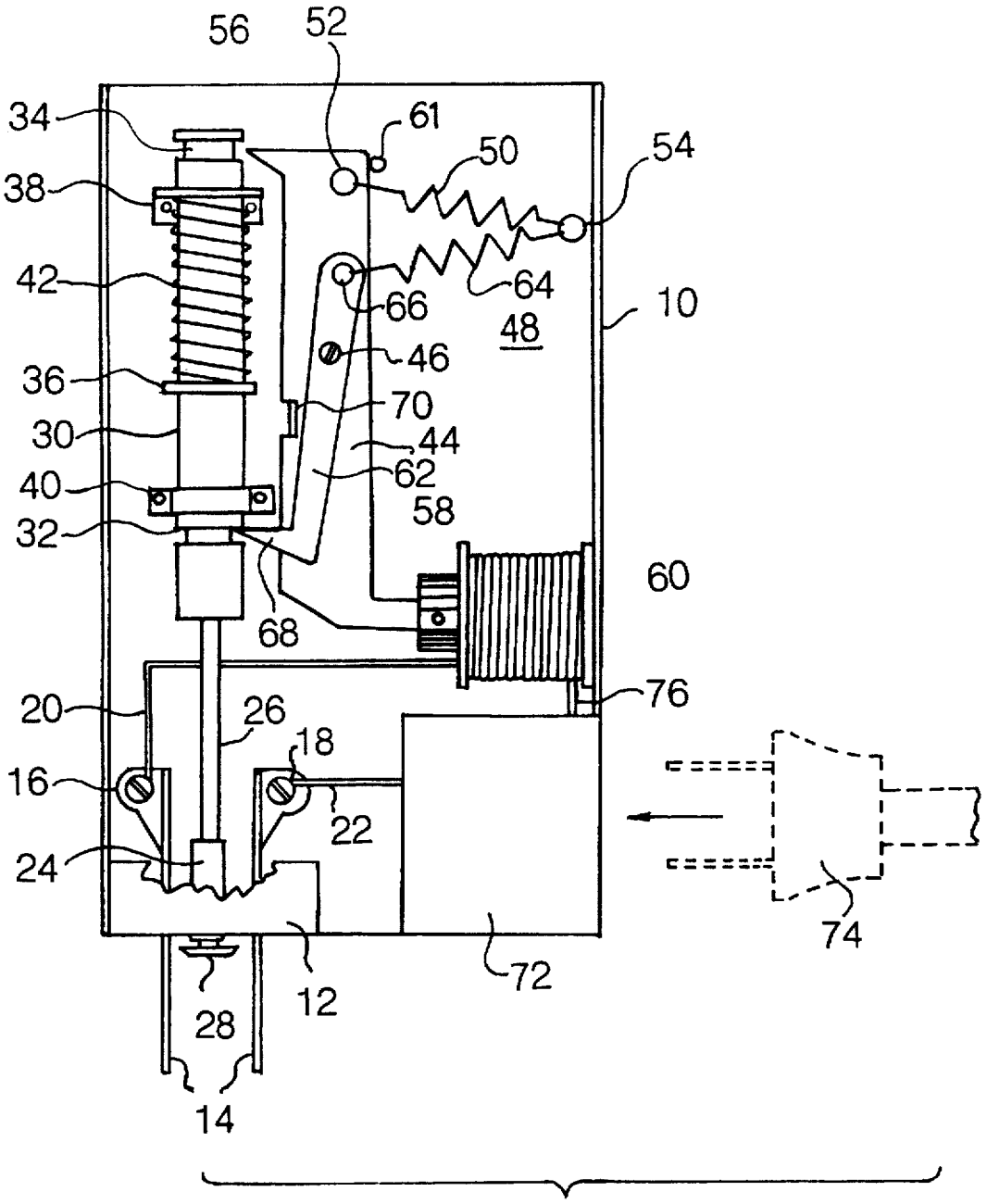

FIG. 1 shows an exemplary embodiment of an automatic disconnector in accordance with the principles of the invention. A frame or chassis 10 has mounted thereon a housing 12, shown in partial section, from which extend a pair of prongs or blades 14 for forming a standard household plug for mating cooperative engagement with a receptacle outlet, not shown, such as a wall outlet for household current. Blades 14 are secured against movement in housing 12 such as by molding or an equivalent fastening method. Respective screw terminals 16 and 18 are formed on ends of blades 14 extending into frame 10 for receiving and securing conductors 20 and 22 respectively. Housing 12 includes a tube containing a passageway for allowing slidable motion therethrough of a plunger rod or ejector 26. Plunger rod 26 carries at its one end an actuator portion 28 situated substantially between blades 14. Plunger rod 26 has a cam portion 30 of greater diameter than the portion of plunger rod 26 which carries actuator portion 28. Cam portion 28 includes a first annular recess 32 located proximate the actuator end of plunger rod 26 and a second annular recess 34 distal from the actuator end of plunger rod 26. Cam portion 28 further includes a shoulder portion 36. Cam portion 30 passes through first and second bearing straps 38 and 40 affixed to frame 10, which allow cam portion 30 to slide freely therethrough but restrain it against any translational movement. A spiral spring 42 is compressed between shoulder portion 36 and bearing strap 38 so as to urge cam portion 30, and thereby to urge plunger rod 26, to slide towards the direction of the actuator end of plunger rod 26.

A first rocker arm 44 is pivotably mounted to frame 10 by means of a pivot screw 46, such that rocker arm 44 can pivot freely in a plane parallel to the plane of a flat portion 48 of frame 10. A tension spring 50 has one end thereof attached to rocker arm 44 by way of a hole 52 and the other end attached to frame 10 by way of a hole 54. Rocker arm 44 has at one end a pawl 56 for selectively engaging recess 34, acting as a selectively operable latch. At its other end, rocker arm 44 carries an armature 58 for selective actuation by means of a solenoid winding 60. A stop pin 61 prevents rocker arm 44 from rotating further in response to the urging of spring 50.

A second rocker arm 62 is also pivotably mounted to frame 10 by means of pivot screw 46, such that rocker arm 62 can pivot freely in a further plane parallel to and close to the plane of movement of the first rocker arm 44. A tension spring 64 has one end thereof attached to 62 by way of a hole 66 and the other end attached to frame 10 by way of hole 54. Rocker arm 62 exhibits a pawl 68 for selectively engaging recess 32 acting as a selectively operable latch. First rocker arm 44 exhibits a tab or catch 70 along its edge proximate plunger rod 26 and on the same side of pivot screw 46 as pawl 68. Tab 70 is adapted to engage selectively second rocker arm 62 such that at a certain point of rotation of rocker arm 62 is constrained from further rotation relative to first rocker arm 44 so that the engagement of pawl 68 with recess 32 depends in part on the position of first rocker arm 44.

An outlet socket 72 is affixed to frame 10, for receiving a plug 74, shown in dashed outline. The contacts and leads within socket 72 are similar to such as are utilized in a conventional outlet wall socket and need not be further described. Conductor 22 connects one of blades 14 to one pole, not shown, of socket 72. The other of blades 14 is connected by way of conductor 20 to one end of solenoid 60. The other end 76 of solenoid 60 is connected to the other pole of socket 72.

In a rest position without engagement of either pawl, plunger rod 26 will be in its lowest position, that is, towards the bottom of the drawing in FIG. 1. This is because of the force exerted by spring 42.

In operation, two modes are possible. In a first mode, an automatic disconnector in accordance with the principles of the invention, as shown in the exemplary embodiment of FIG. 1 is plugged into a live outlet receptacle, such as a wall outlet, not shown, with an appliance plug already inserted into socket 72 where the appliance is switched off or with no appliance plug inserted into socket 72.

In a second mode, the automatic disconnector is plugged into a live outlet receptacle with an appliance plug already inserted into socket 72 where the appliance is switched on.

Considering the first mode, where the appliance is switched off or there is no appliance plug inserted into socket 72, when blades 14 are inserted into, for example, a wall outlet receptacle, actuator portion 28 will be pushed in towards frame 10 by the wall-late of the wall outlet, thereby moving actuator rod 26 in an upward direction in reference to FIG. 1. With no current flowing through solenoid winding 60, rocker arm 44 will be resting against stop pin 61 under the action of spring 50. Pawl 56 cannot reach recess 34 to engage it. Because tab 70 is its maximum clockwise position due to the position of rocker arm 44, rocker arm 62 is positioned by spring 64 such that pawl 68 can engage recess 32 as plunger rod 26 is pushed in by the action of inserting blades 14 into an outlet receptacle.

Accordingly, plunger rod is latched by pawl 68 and remains in that position when the automatic disconnector has been fully inserted into a wall outlet. When current is drawn from receptacle 72, either by plugging in an appliance which is already switched on or by switching on an appliance previously plugged into receptacle 72, solenoid winding 60, which is in series circuit with the supply to receptacle 70, becomes energized by this current. Armature 58 is drawn into winding 60 by an electromagnetically generated force, thereby causing rocker arm 44 to rotate in a counterclockwise manner about pivot screw 46. This causes pawl 56 to enter recess 34. However, the dimensions and position of recess 34 are such that no contact occurs initially between the engaging upper edge of recess 34 and pawl 56, so that the force of spring 42 continues to be resisted by pawl 68 in recess 32. Upon continuing rotation of rocker arm 44 as armature 58 continues to be drawn further into solenoid coil 60, tab 70 engages rocker arm 62, eventually causing pawl 68 to disengage from recess 32, whereupon plunger rod 26 is driven downward by the force of spring 42. However, plunger rod 26 only moves a small distance before the upper surface of recess 34 engages pawl 56 which effectively prevents any further motion of plunger rod 26. This distance moved is nevertheless sufficient to preclude pawl 68 from being able to reengage into recess 32 which has now moved too far down. Accordingly, actuator portion 28 only moves down a very small distance and the automatic disconnector remains plugged into the wall outlet.

If the appliance which was plugged into receptacle 72 is now switched off, current flow through solenoid winding 60 ceases and armature 58 is released. Spring 50 can now rotate rocker arm thereby disengaging pawl 56 from recess 34 and freeing plunger rod 26 to move downward under the action of spring 42. This causes actuator portion 28 to push against the wall-plate of the wall outlet, and thereby eject the automatic disconnector from the outlet.

The second mode of operation will next be considered, wherein the automatic disconnector is plugged into a live outlet receptacle with an appliance plug already inserted into socket 72 where the appliance is switched on.

As before, the actuator portion 28 will be pushed in by the wall-plate when the automatic disconnector is plugged into a wall outlet, thereby forcing plunger rod 26 in an upward direction, relative to the drawing. Solenoid winding 72 will be energized immediately upon insertion of blades 14 into the wall outlet and consequently, rocker arm 44 will already be in a counter clockwise position as plunger rod moves up, with pawl 56 in a position to engage into recess 34 as it moves up. The end of plunger rod 26 will displace rocker arm 44 temporarily against the solenoid action on armature 58 in a clockwise manner by sliding along the inclined lower edge of pawl 56. As recess 34 comes up into position, pawl 56 will enter recess 34 responsive to the solenoid action on armature 58. At the same time, tab 70 will restrain rocker arm 62 such that pawl 68 cannot engage into recess 32.

When the force inserting the automatic disconnector has ceased pushing it in, spring 42 will cause actuator portion 28 to push against the wall-plate thereby tending to extract blades 14 from the wall socket. However, this only occurs for a very small distance until the top portion of recess 34 has been engaged by pawl 56, whereupon motion of actuator portion 28 ceases and the blades remain substantially inserted in the outlet. As explained above in the description of the first mode, this configuration results in recess 32 being too low for pawl 68 to enter it for engagement even if rocker arm 62 were free to move.

Upon the appliance being switched off, solenoid winding 60 will no longer be energized and spring 50 will withdraw pawl 56 from recess 34. Although rocker arm 62 is also thereby released by the movement of tab 70, recess 32 is too low to be entered by pawl 68 as has been previously explained. Thus, plunger rod 26 is released to be pushed down by the force of spring 42, thereby causing actuator portion 28 to push against the wall-plate and so force the automatic disconnector to become unplugged from the wall outlet.

Figure 2:
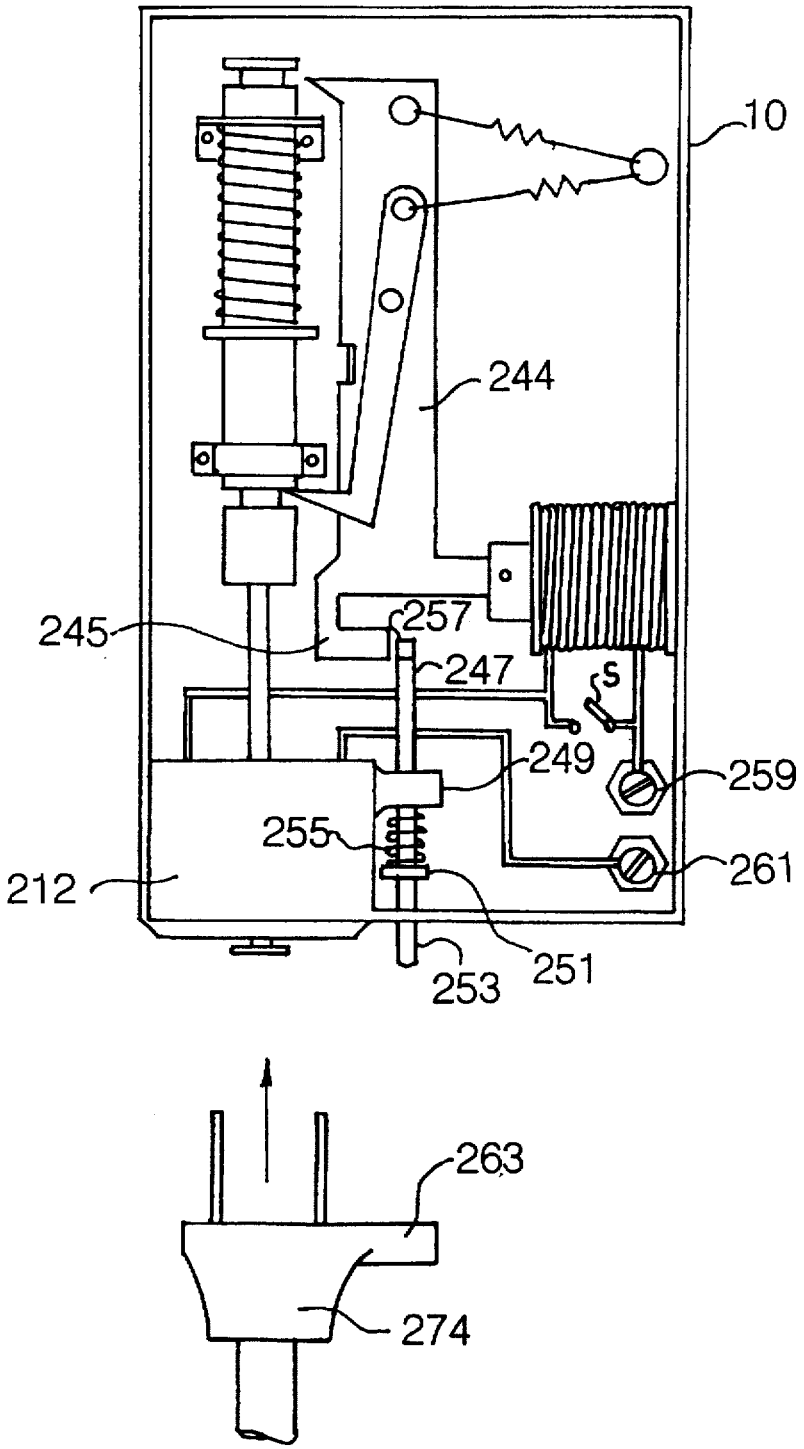
FIG. 2 shows another exemplary embodiment in accordance with the invention.

FIG. 2 shows another embodiment in accordance with the invention wherein the automatic disconnector is included in an outlet socket so as to form an automatic disconnector outlet for ejecting a plug therefrom when an appliance or load is switched off. Like parts in FIGS. 1 and 2 are indicated by like reference numerals.

In FIG. 2, a housing 212, mounted on frame 10, includes an outlet receptacle, similar to a standard wall receptacle, for receiving a plug such as for an appliance. Various parts in the automatic disconnector outlet operate similarly to their counterparts in the FIG. 1 embodiment, with exceptions and differences to be described.

Figure 3:
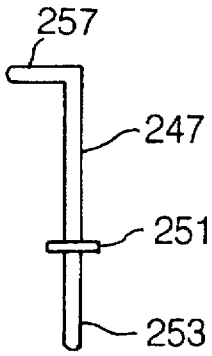
FIG. 3 shows another view of part of the embodiment of FIG. 2.

In FIG. 2, rocker arm 244 exhibits a cam portion 245 for engaging a control rod 247. Control rod 247 is of square cross-section and is slidably mounted in a square bearing hole in a boss 249 attached to housing 212. Control rod 247 exhibits a flange 251 and has one end 253 for selectively protruding from frame 10, in close proximity to the outlet socket in housing 212. A compression spring 255 biases the movement of control rod 247 for causing it normally to protrude from frame 10. As is also shown in FIG. 3, the other end of control rod 247 is bent at a right angle in a direction for forming a portion 257 thereof for selectively engaging cam portion 245. In the normal extended position of control rod 247, portion 257 prevents rocker arm 244 from moving in response solenoid 60 being energized.

One pole of the receptacle socket in housing 212 is connected to one end of solenoid winding 60 and the other pole of the receptacle socket is connected to a terminal 259 for connection to one bus of an electrical supply main. The other end of solenoid winding 60 is connected to another terminal 261 for connection to the other bus of the electric supply main. Plug 274, for providing power to an appliance is optionally equipped with a keying element in the form of a protuberance 263.

In operation, when an appliance plug not exhibiting protuberance 263 is inserted into the receptacle socket in housing 212, plunger rod 26 is pushed in and is latched by pawl 68. However, control rod 247 is not affected and movement of rocker arm 244 continues to be blocked by portion 257 of rod 247. Energization and deenergization of solenoid winding therefore have no effect and the plug remains inserted.

When an appliance plug exhibiting protuberance 263 is inserted, control rod 247 is pushed in clear of cam portion 245. Accordingly, rocker arm 244 is no longer blocked. Operation then is essentially in accordance with that described for the embodiment of FIG. 1, except that when plunger rod 26 is released, it pushes out plug 274 and itself remains part of the outlet socket.

Figure 4:
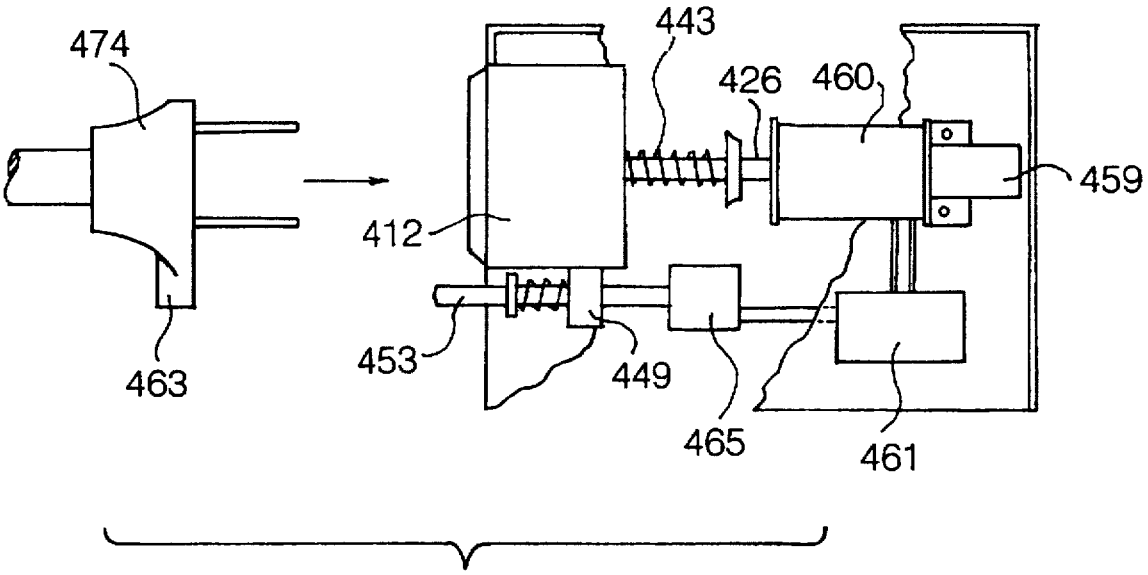
FIG. 4 shows a further exemplary embodiment in accordance with the invention.

In the exemplary embodiment in accordance with the invention shown in FIG. 4, an automatic disconnector outlet includes a solenoid winding 460 operating directly on a plunger 426 and spring 443 by way of an armature 459 for ejecting a plug 474 from the outlet. An electronics package 461, to be described in greater detail below, senses the cessation of current flow through the plug to an appliance and causes solenoid winding 460 to be energized. A sensing switch 465 is operable by control rod 453 passing through a boss 449 for disabling the electronics package 461 from energizing solenoid winding 460 in the event a plug without a protuberance 463 is utilized so that such a plug will not be ejected. Clearly it must understood that electronics package 461 can be included in like manner in the examples of FIGS. 1 and 2 so as to form further embodiments in accordance with the invention. It should also be understood that sensing switch 465 can also be utilized in the embodiments of FIG. 1 for selectively shorting out the winding of solenoid 60 instead of using rod 257.

Figure 5:
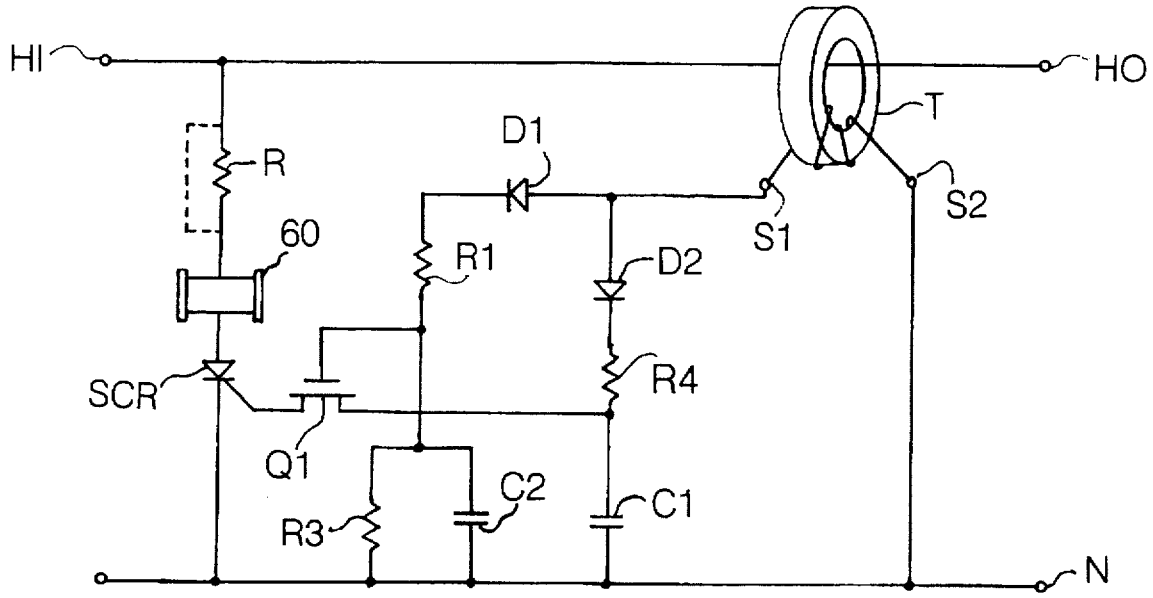
FIGS. 5 and 6 show further details relating to the embodiment of FIG. 4.

FIG. 5 shows an embodiment of electronics package 461, as also described in the copending application entitled ELECTRONIC CIRCUIT FOR AUTOMATIC DISCONNECTOR and being filed in the names of A.A. Ahmed and S.O. Ahmed on even date herewith and whereof the disclosure is herein incorporated by reference. This application has been accorded Ser. No. 08/665,381. The main supply buses are connected to terminals HI and N, indicating, for example, the hot lead and the neutral, respectively. Terminals HO and N indicate the connections to the outlet socket in housing 412 in the case of an automatic disconnector outlet. The connecting conductor between HI and HO passes through a magnetic core for forming the primary winding of a toroidal transformer T and a secondary winding is provided on the magnetic core, with terminals S1 and S2. Terminal S2 is coupled to terminal N. Terminal S1 is coupled to the anodes of diodes D1 and D2. The cathode of diode D2 is coupled by way of a resistor R2 to one pole of a capacitor C1, the other pole of C1 being coupled to terminal N. The cathode of diode D2 is coupled by way of a resistor R1 to one pole of a capacitor C2, the other pole of C2 being coupled to terminal N. A resistor R3 is coupled in shunt across C2. One end of solenoid 60 is coupled to terminal HI and the other end of solenoid 60 is coupled to the anode of a silicon controlled rectifier SCR or some other suitable controlled conduction device such as a thyristor, thyratron, transistor, opto-electronic switch or a relay, optionally by way of a series resistor R. The cathode of SCR is coupled to terminal N. A field effect transistor Q1, having a main conducting path and a control electrode for controlling current flow in the main conduction path has one end of its main conducting path coupled to the junction node of capacitor C1 and resistor R2 and the other end of its main conducting path coupled to the gate electrode of SCR. The control electrode of Q1 is coupled to the junction node of resistor R1 and capacitor C2.

In operation, when a load current flows through the primary winding of transformer T, capacitor C1 is charged by way of rectifier diode D2. Likewise, capacitor C2 is charged to a lower voltage determined by the ratio of resistors R1 and R3. The resistance of resistor R3 is such that the voltage across capacitor C2 does not drop appreciably during the negative or non-charging half-cycle of the supply voltage. The voltages across C1 and C2 are so arranged that transistor Q1 remains non-conductive. When the current through the primary winding of transformer T is interrupted, such as by switching off an appliance being supplied through the automatic disconnector outlet, capacitor C2 is rapidly discharged through resistor R3. Capacitor C1 remains charged. At a point where the falling voltage across C2 causes transistor Q1 to start conducting, the voltage across C1 is coupled to the gate electrode of the silicon controlled rectifies SCR, thereby causing it to fire and energize solenoid 60. The appliance plug is thereby ejected. Shortly thereafter, C1 will be further discharged by way of Q1 and the solenoid will be deenergized if it has not already been deenergized by the supply's having been disconnected.

Figure 6:
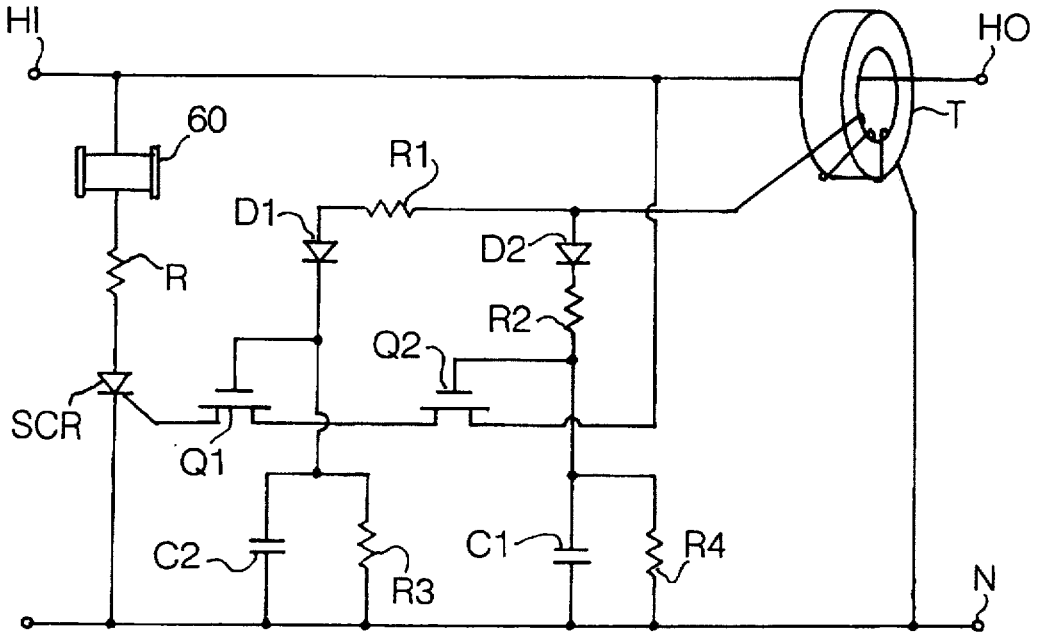

In the embodiment of FIG. 6, an additional transistor Q2 has its main conduction path coupled between terminal HI and that end of the main conduction path of Q1 which in the FIG. 1 embodiment was coupled to the junction node of C1 and R2. Accordingly, when SCR fires, its gate current is supplied from terminal HI by way of Q2, rather than from capacitor C1, which in this case supplies only the gate voltage for making Q2 conductive. A relatively high-valued resistor R4 in shunt with C1 provides for the eventual discharge of C1 for ending the supply of gate turn-on voltage to SCR after an appropriate interval of operation.

The present invention has been described by way of exemplary embodiments. Various changes and modifications will suggest themselves to one of skill in the art to which it pertains and changes of this sort are intended to be within the contemplation of the invention. For example, the various rocker configurations and the like are readily susceptible to change in form while preserving the essential function. Spiral springs may be replaced by cantilever springs or other biasing arrangements. Circuit arrangements for performing similar functions may be made somewhat differently from the actual exemplary configurations shown herein. Inversion of various parts as may pertain to a socket or a plug is within the spirit of the invention.

Furthermore, the details of the actual release mechanism of actuator may be readily changed without departure from the concept disclosed herein. An external sleeve may be used in place of a pin. For example, a mechanism essentially like that disclosed in the afore-mentioned U.S. Pat. No. 5,211,569 issued May 18, 1993 in the name of Havens and entitled ELECTRICAL POWER CORD AND APPLIANCE USING SAME, or in U.S. Pat. No. 5,266,040, issued Nov. 30, 1993 in the names of Merrill et al., entitled RELEASABLE ELECTRIC CONNECTOR ASSEMBLY, may be substituted for the exemplary mechanism herein describe.

While the described embodiments utilize sliding plungers and actuators, it is readily seen that pivoted elements may be used with relatively minor mechanical redesign so that portion 28, for example, is mounted on a rotational member having corresponding arcuate cam portions and movements. In this case, a spiral spring can be substituted in place of illustrated spring 42.

Inversion of various parts as may pertain to a socket or a plug is also within the conception of the invention. Furthermore, it is apparent that the invention may be embodied as an intermediate connector or adapter unit having a plug and a receptacle, adapted to be plugged into an outlet receptacle and to have a plug inserted into it, so that the plug can be ejected from the adapter unit. It is also forseen that a disabling switch can be incorporated into an embodiment of the invention for selectively disabling the ejecting function. This can take the form of a mechanical blocking or a simple shorting switchs across the solenoid winding. This function can be combined with the function of control rod 257 or sensing switch 465, for example.

These and other like changes and modifications are intended to be within the scope and spirit of the invention which is defined by the claims following.

The invention claimed is:

1. An automatic disconnector for a plug for supplying supply current to an appliance, said disconnector comprising:

ejector means for ejecting said plug from an outlet;

sensing means for sensing supply current flow being drawn by said appliance through said plug and for sensing a substantial cessation of said supply current flow caused by said appliance being switched off; and means coupling said ejector means to said sensing means for causing ejection of said plug upon said substantial cessation of said supply current flow.

2. An automatic disconnector for a plug in accordance with claim 1, comprising means for sensing whether a specially adapted plug has been inserted into said outlet.

3. An automatic disconnector for a plug in accordance with claim 2, wherein said means for sensing whether a specially adapted plug has been inserted into said outlet is coupled to said ejector means for inhibiting said ejection unless said specially adapted plug has been inserted into said outlet.

4. An automatic disconnector for a plug in accordance with claim 3, wherein said sensing means for sensing current flow through said plug and for sensing a substantial cessation of said current flow comprises an electromechanical arrangement.

5. An automatic disconnector for a plug in accordance with claim 3, wherein said sensing means for sensing current flow through said plug and for sensing a substantial cessation of said current flow comprises an electronic circuit.

6. An automatic disconnector for a plug in accordance with claim 2, wherein said sensing means for sensing current flow through said plug and for sensing a substantial cessation of said current flow comprises an electromechanical arrangement.

7. An automatic disconnector for a plug in accordance with claim 2, wherein said sensing means for sensing current flow through said plug and for sensing a substantial cessation of said current flow comprises an electronic circuit.

8. An automatic disconnector for a plug in accordance with claim 1, wherein said sensing means for sensing current flow through said plug and for sensing a substantial cessation of said current flow comprises an electromechanical arrangement.

9. An automatic disconnector for a plug in accordance with claim 1, wherein said sensing means for sensing current flow through said plug and for sensing a substantial cessation of said current flow comprises an electronic circuit.

10. An automatic disconnector, including a receptacle for receiving a plug for supplying supply current to a load, comprising:

means for causing ejection of said plug upon substantial cessation of supply current flow through said plug; and means for sensing whether a specially adapted plug has been inserted into said receptacle and being coupled to said means for causing ejection for inhibiting said ejection unless a specially adapted plug has been inserted into said outlet.

11. An automatic disconnector, comprising:

a plug portion having first and second prongs or blades for engaging electrical outlet receptacle contacts;

means for connecting said prongs to an electrical load for supplying supply current thereto;

a selectively operable ejector having a retracted operating position and an extended operating position for causing said prongs to become separated from said contacts;

biasing means for urging said ejector to move into said extended operating position;

a first selectively operable latch for holding said ejector substantially in said retracted operating position;

a second selectively operable latch for holding said ejector substantially in said retracted operating position; and an electrically operated mechanism electrically coupled to at least one of said first and second prongs and being mechanically coupled for operating said latches in response to predetermined changes in said supply current flow through said prongs.

12. An automatic disconnector for a plug as recited in claim 11, wherein said first selectively operable latch operates to hold said ejector in said retracted position upon insertion of said prongs into said electrical outlet in the event substantially no current is being drawn by said electrical load.

13. An automatic disconnector for a plug as recited in claim 11, wherein said second selectively operable latch operates to hold said ejector in said retracted position upon insertion of said prongs into said electrical outlet in the event a current is being drawn by said electrical load.

14. An automatic disconnector for a plug as recited in claim 13, wherein said second selectively operable latch includes means for inhibiting further operation of said first selectively operable latch for holding said ejector in said retracted position once current has been drawn by said electrical load.

15. An automatic disconnector for a plug as recited in claim 14, wherein said electrically operated mechanism operates to cause said second selectively operable latch to cease holding said ejector in said retracted position upon substantial cessation of said current being drawn by said electrical load, whereby said ejector is released for movement out of said retracted position.

16. An automatic disconnector for a plug as recited in claim 15, wherein said electrically operated device is a solenoid having an armature means coupled for operating said latches.

17. An automatic disconnector for a plug as recited in claim 11, wherein said latches comprise respective cranks or bell-cranks, said first selectively operable latch is spring-loaded for operating to hold said ejector in said retracted position, said biasing means for urging said ejector to move into said extended operating position comprises a spring, and wherein said means for inhibiting further operation of said first selectively operable latch comprises a portion of said second latch for selectively engaging said first latch so as to prevent its operating to hold said ejector in said retracted position when said current is being drawn by said electrical load.

18. An automatic disconnector for a plug, comprising:

an electrical receptacle having first and second contacts for mating engagement with a plug portion having first and second prongs or blades for supplying supply current to a load;

means for connecting said contacts to an electrical supply;

a selectively operable ejector having a retracted operating position and an extended operating position for causing said prongs to become separated from said contacts;

biasing means for urging said ejector to move into said extended operating position;

a first selectively operable latch for holding said ejector substantially in said retracted operating position;

a second selectively operable latch for holding said ejector substantially in said retracted operating position; and an electrically operated mechanism electrically coupled to at least one of said first and second prongs and being mechanically coupled for operating said latches in response to predetermined changes in said supply current flow through said prongs.

19. An automatic disconnector for a plug as recited in claim 18, wherein said first selectively operable latch operates to hold said ejector in said retracted position upon insertion of said prongs into said electrical outlet in the event substantially no current is being drawn by said electrical load.

20. An automatic disconnector for a plug as recited in claim 18, wherein said second selectively operable latch operates to hold said ejector in said retracted position upon insertion of said prongs into said electrical outlet in the event a current is being drawn by said electrical load.

21. An automatic disconnector for a plug as recited in claim 18, wherein said second selectively operable latch includes means for inhibiting further operation of said first selectively operable latch for holding said ejector in said retracted position once current has been drawn by said electrical load.

22. An automatic disconnector for a plug as recited in claim 21, wherein said electrically operated mechanism operates to cause said second selectively operable latch to cease holding said ejector in said retracted position upon substantial cessation of said current being drawn by said electrical load.

23. An automatic disconnector for a plug as recited in claim 22, wherein said electrically operated device is a solenoid having an armature coupled for operating said latches.

24. An automatic disconnector for a plug as recited in claim 18, wherein said latches comprise respective cranks or bell-cranks, said first selectively operable latch is spring-loaded for operating to hold said ejector in said retracted position, said biasing means for urging said ejector to move into said extended operating position comprises a spring, and wherein said means for inhibiting further operation of said first selectively operable latch comprises a portion of said second latch for selectively engaging said first latch so as to prevent its operating to hold said ejector in said retracted position when said current is being drawn by said electrical load.

25. An automatic disconnector for a plug as recited in claim 18, including means operable by a keying element and being coupled to said electrically operated mechanism for selectively enabling and disabling operation thereof; and wherein said plug portion optionally exhibits a keying element for cooperatively engaging said means operable by a keying element for enabling operation of said electrically operated mechanism.

26. An automatic disconnector for a plug as recited in claim 25, wherein said keying element is a lateral protuberance for engaging said means operable by a keying element.

27. An automatic disconnector for a plug as recited in claim 26, wherein said electrically operated mechanism is enabled for operation when a plug is utilized therewith exhibiting said keying element and wherein said electrically operated mechanism is disabled for operation when a plug is utilized therewith not exhibiting said keying element.

28. An automatic disconnector for a plug as recited in claim 27, wherein said means operable by a keying element comprises a spring-loaded pin for selectively blocking operation of said latches.

29. An automatic disconnector for a plug as recited in claim 27, wherein said means operable by a keying element comprises a switch for selectively bypassing said electrically operated mechanism.

30. An automatic disconnector for a plug as recited in claim 18, including manually operable means for selectively enabling and disabling operation of said automatic disconnector.

31. An automatic disconnector for ejecting a plug from an outlet connected to a source of an electric supply voltage, including a sensor for sensing a substantial cessation of a supply current flow through said plug and an ejector coupled to said sensor and being responsive thereto for ejecting said plug upon occurrence of said substantial cessation of said supply current flow while said supply voltage is present.

32. An automatic disconnector for a plug as recited in claim 31, wherein said sensor comprises a solenoid.

33. An automatic disconnector for a plug as recited in claim 32, wherein said ejector comprises an ejector element and a spring-loaded latching mechanism responsive to said solenoid for controlling said element.

34. An automatic disconnector for a plug as recited in claim 31, wherein said latching mechanism operates to latch said ejector element in a retracted position upon insertion of the plug into the outlet, regardless of whether current is flowing through the plug at the moment of said insertion.

35. An automatic disconnector for a plug as recited in claim 31, wherein said latching mechanism operates to release said ejector element from said retracted position upon a substantial cessation of any current flowing through the plug.

36. A method for automatically ejecting a plug from an outlet connected to an electric supply voltage, comprising the steps of:

sensing a substantial cessation of supply current flow being drawn by a load through said plug; and, responsive to an occurrence of said substantial cessation of supply current flow while said supply voltage is present, operating an ejection mechanism for ejecting said plug from said outlet.

37. A method as recited in claim 36 comprising:

latching said ejection mechanism in a retracted position upon insertion of the plug into the outlet, regardless of whether supply current is flowing through the plug at the moment of said insertion.

38. A method as recited in claim 37 comprising:

releasing said ejection mechanism from said retracted position upon a substantial cessation of any supply current flowing through the plug.

* * * * *